US007445272B2

(12) United States Patent
Lee

(10) Patent No.: US 7,445,272 B2
(45) Date of Patent: Nov. 4, 2008

(54) UPPER FRAME STRUCTURE FOR SUPPORTING CAB OF CONSTRUCTION MACHINERY

(75) Inventor: Jin Woo Lee, Kimhae (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 11/820,665

(22) Filed: Jun. 20, 2007

(65) Prior Publication Data

US 2008/0073938 A1 Mar. 27, 2008

(30) Foreign Application Priority Data

Sep. 22, 2006 (KR) ..... 10-2006-0092343

(51) Int. Cl.
*B62D 33/06* (2006.01)

(52) U.S. Cl. ..... 296/190.03; 296/190.08; 180/89.12

(58) Field of Classification Search ..... 296/187.08, 296/190.03, 190.08, 190.01, 193.07, 29; 180/89.12; 280/784; 37/347
See application file for complete search history.

(56) References Cited

U.S. PATENT DOCUMENTS 7,131,686 B1 * 11/2006 Jo et al. ..... 296/190.03
2004/0245806 A1 * 12/2004 Mori et al. ..... 296/187.03
2005/0000121 A1 * 1/2005 Mori ..... 37/347
2006/0125287 A1 * 6/2006 Fornell et al. ..... 296/190.03
2006/0158006 A1 * 7/2006 Mori ..... 296/190.03
2006/0249986 A1 * 11/2006 Yoon ..... 296/190.03
2007/0018484 A1 * 1/2007 Lee ..... 296/190.08
2007/0035160 A1 * 2/2007 Murakami ..... 296/190.03
2007/0085380 A1 * 4/2007 Murakami et al. ..... 296/190.08

* cited by examiner

*Primary Examiner*—Jason S Morrow
(74) *Attorney, Agent, or Firm*—Ladas & Parry LLP

(57) ABSTRACT

An upper frame structure for supporting a cab of construction machinery is disclosed, which can support the cap mounted on the upper frame when a vertical load, which is so much that the cab structure is plastically deformed, is applied to the upper frame. The upper frame structure includes a center frame having a bottom plate on which a swing ring gear is mounted and a pair of side plates vertically fixed to the bottom plate and on which operation devices are mounted; a left frame mounted on a left side of the center frame and having a left side frame on which the cab is mounted; reinforcement members each of which has one end fixed by welding to a side surface of the side plate of the center frame and the other end fixed by welding to a side surface of the left side frame, and on which the cap is mounted; and a fastening member installed on the bottom plate to offset a load vertically applied to the cab and a load laterally applied to the cab, and fixing the reinforcement member to the bottom plate.

11 Claims, 9 Drawing Sheets

UPPER FRAME STRUCTURE FOR SUPPORTING CAB OF CONSTRUCTION MACHINERY

CROSS-REFERENCE TO RELATED APPLICATION

This application is based on and claims priority from Korean Patent Application No. 10-2006-92343, filed on Sep. 22, 2006 in the Korean Intellectual Property Office, the disclosure of which is incorporated herein in its entirety by reference.

BACKGROUND OF THE INVENTION

1. Field of the Invention

The present invention relates to an upper frame structure for supporting a cab of construction machinery, which can disperse and offset a load transferred to the cab due to a rollover of the heavy construction machinery and so on.

More particularly, the present invention relates to an upper frame structure for supporting a cab of construction machinery, which can support the cap mounted on the upper frame when a vertical load, which is so much that the cab structure is plastically deformed, is applied to the upper frame.

2. Description of the Prior Art

As illustrated in FIG. 1, a general excavator includes a lower driving structure 1; an upper swing structure 2 mounted on the lower driving structure 1 and being swiveled in left and right directions by a driving means (not illustrated) including a swing motor, a swing gear, and so forth; a cap 3 and an engine room 4 mounted in front and in the rear of the upper swing structure 2; a working device 11 composed of a boom 5 rotatively mounted on the upper swing structure 2 on one side of the cap 3, an arm 6, a bucket 7, and hydraulic cylinders 8, 9, and 10 for driving them; and a counterweight 12 having a weight material such as AG and mounted on the rear part of the engine room 4 to balance the equipment during working.

As illustrated in FIGS. 2A, 2B, 2C, 2D, and 3, a conventional upper frame structure for supporting a cap of construction machinery includes a bottom plate 13*a* having a bottom surface on which a swing ring gear (not illustrated) is mounted; a center frame 13 vertically fixed to the bottom place 13*a* by welding, and including a pair of side plates 13*b* on which the working device 11 composed of the boom 5 and so on is installed; a right side frame 14 which is mounted on the right side of the center frame 13, and on which a fuel tank, a hydraulic tank, a main control valve (MCV), and so forth, are installed; and a left side frame 15 which is mounted on the left side of the center frame, and on which the cap 3 is mounted.

The left side frame 15 may further include a front reinforcement member 15*a*, a center reinforcement member 15*b*, and a rear reinforcement member 15*c*, on which the cap 3 is mounted.

A vibration absorption device (not illustrated) is mounted on the left side frame 15, and thus an impact or vibration being transferred from the lower driving structure 1 to the cap 3 can be absorbed or relieved.

On the other hand, as illustrated in FIGS. 2A, 2C, and 2D, the reinforcement member of the left side frame 15, on which the cap 3 is mounted, is fixed by welding to the side plate 13*b* of the center frame 13 only. That is, side surfaces of the center reinforcement member 15*b* and the rear reinforcement member 15*c* of the left side frame 15 are fixed by welding to a side surface of the side plate 13*b* of the center frame 13 (indicated as "B" and "D" in the drawings).

In other words, the bottom surfaces of the center reinforcement member 15*b* and the rear reinforcement member 15*c* are supported with respect to an upper surface of the bottom plate 13*a* of the center frame 13, without being welded to the bottom plate. That is, in the case of directly fixing the center reinforcement member 15*b* and the rear reinforcement member 15*c* to the bottom plate 13*a* by welding, a bending deformation may occur on the bottom surface of the bottom plate 13*a* on which the swing ring gear is mounted.

In this case, the bottom plate 13*a* of the center frame 13 has already been welded to the side plate 13*b* and processed by a machining process.

Accordingly, if large load is vertically applied to the left side frame 15 (indicated by an arrow C in FIG. 3) due to a rollover of the construction machinery and so on, concentrated load is applied to welded portions B and D of the center reinforcement member 15*b* and the rear reinforcement member 15*c* to the side plate 13*b*. Accordingly, the strength at the welded portions B and D is weak in structure, and thus the strength reinforcement is keenly required.

That is, when an excessive load, which is so much that the cab is plastically deformed, is vertically applied to the upper frame due to a rollover accident occurring during an excavation work on the spot, the upper frame cannot disperse or offset the load due to the insufficient strength at the welded portions B and D of the reinforcement members 15*b* and 15*c*. Accordingly, most of the load is transferred to the cab 3 to cause the plastic deformation of the cap 3. Also, a large shock is directly transferred to the inside of the cab 3.

Accordingly, when the cab 3 is plastically deformed by a large load that is transferred to the cab 3 due to a rollover of the construction machinery and so on, safety accidents may happen to an operator due to a shock given to the operator.

SUMMARY OF THE INVENTION

Accordingly, the present invention has been made to solve the above-mentioned problems occurring in the prior art, and an object of the present invention is to provide an upper frame structure for supporting a cab of construction machinery, which can secure the stability of the construction machinery by supporting the cap mounted on the upper frame when a vertical shock, which is so much that the cab structure is plastically deformed, is applied to the upper frame.

In one embodiment of the present invention, in the case of manufacturing an upper frame on which a cab is mounted, welding and bolt fastening are selectively adopted to improve the workability and to rectify the structural vulnerability of a structure manufactured only by welding.

In order to accomplish these objects, there is provided an upper frame structure for supporting a cab of construction machinery, including a center frame having a bottom plate on which a swing ring gear is mounted and a pair of side plates which are vertically fixed to the bottom plate and on which operation devices are mounted; and a left frame mounted on a left side of the center frame and having a left side frame on which the cab is mounted, according to an embodiment of the present invention, which includes reinforcement members each of which has one end fixed by welding to a side surface of the side plate of the center frame and the other end fixed by welding to a side surface of the left side frame, and on which the cap is mounted; and a fastening member installed on the bottom plate to offset a load vertically applied to the cab and a load laterally applied to the cab, and fixing the reinforcement member to the bottom plate.

The fastening member may be fixed to form a gap between a bottom surface of the bottom plate and a head part of the fastening member.

The fastening member may be installed at an edge of the bottom plate.

A fastening hole, which is in the form of an elongated hole and into which the fastening member is fastened, may be formed on the bottom plate.

A screw hole may be formed on the reinforcement member so that a screw part of the fastening member is fastened into the screw hole. A nut member may be fixed by welding to a bottom surface of the reinforcement member so that the screw part of the fastening member is fastened into the nut member.

The reinforcement member may be installed in the center or in the rear of the left side frame. The reinforcement members may be installed in the rear and in the center of the left side frame.

At least one fastening member may be installed at an edge of the bottom plate. A washer may be integratedly formed on the head part of the fastening member.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
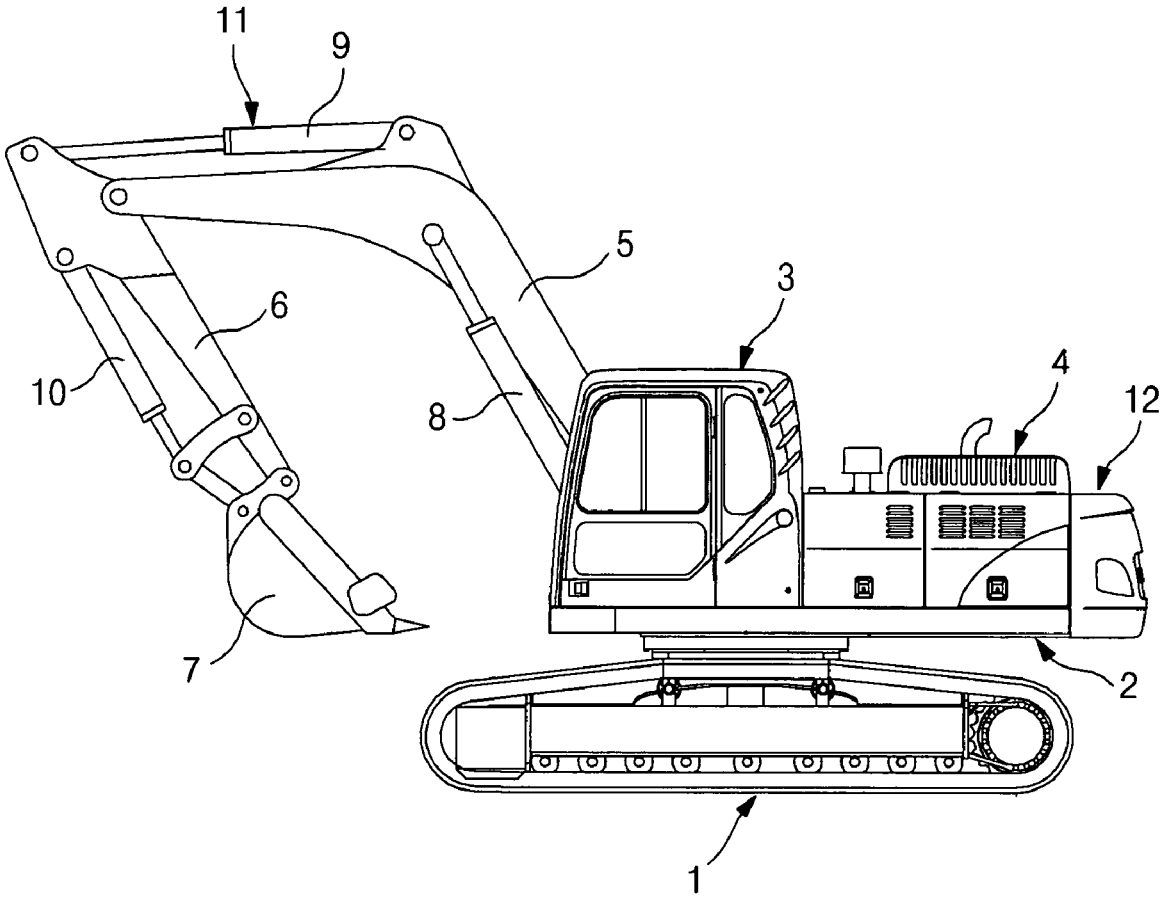
Fig. 1 Prior Art
FIG. 1 is a side view of a conventional excavator.
Figure 2A:
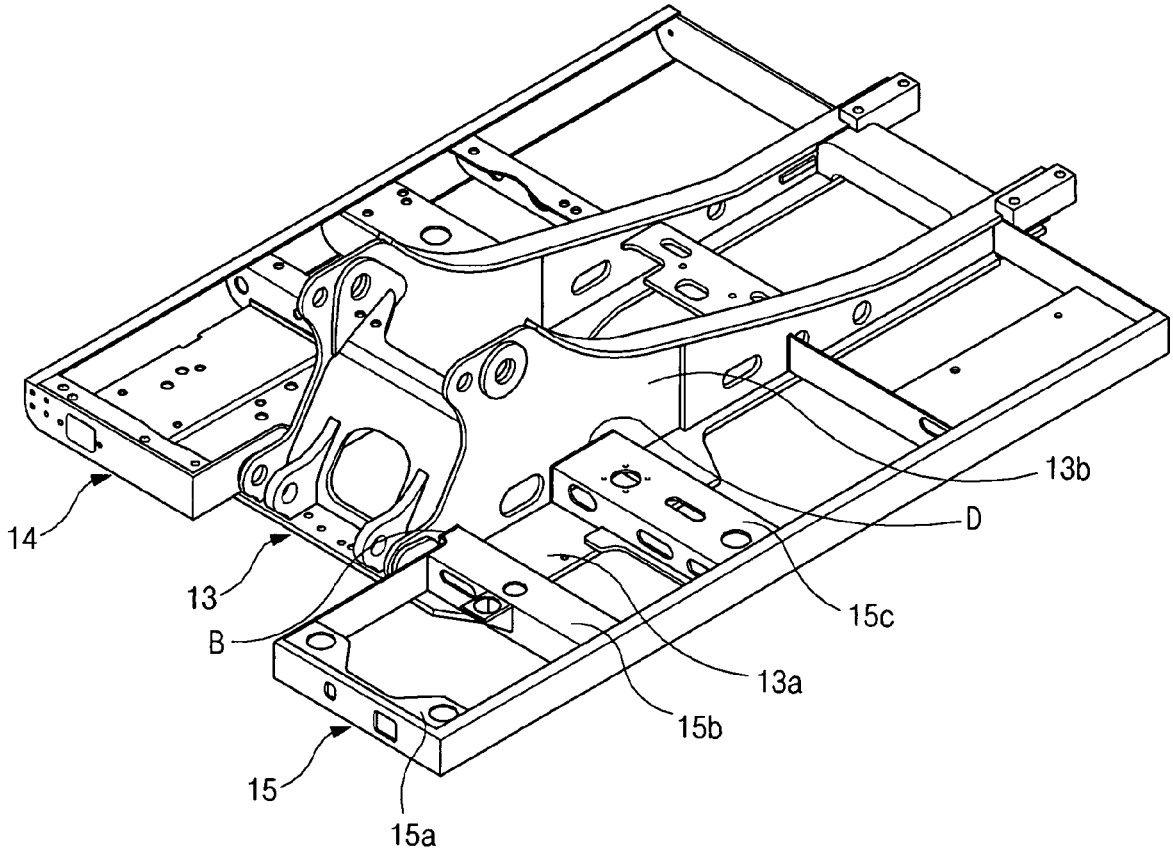
Fig. 2a Prior Art
FIG. 2A is a schematic perspective view of a conventional upper frame on which a cap of construction machinery is mounted.
Figure 2B:
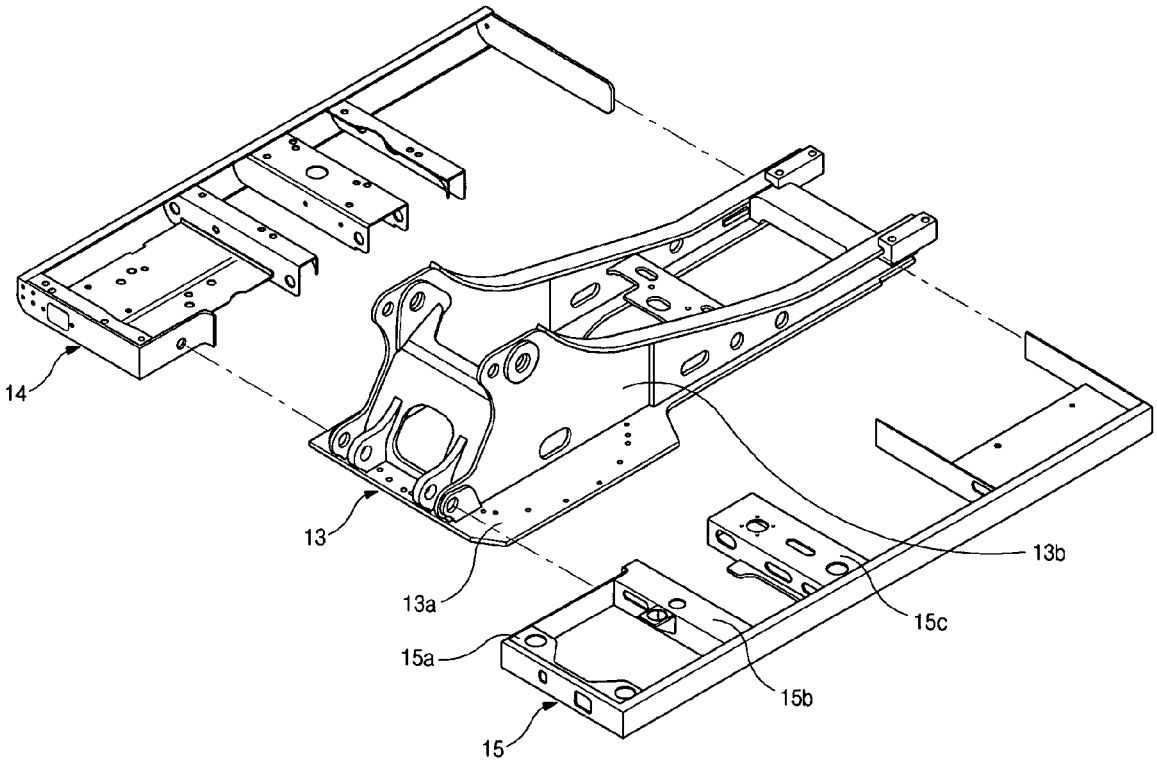
Fig. 2b Prior Art
FIG. 2B is an exploded perspective view of a conventional upper frame on which a cap of construction machinery is mounted.
Figure 2C:
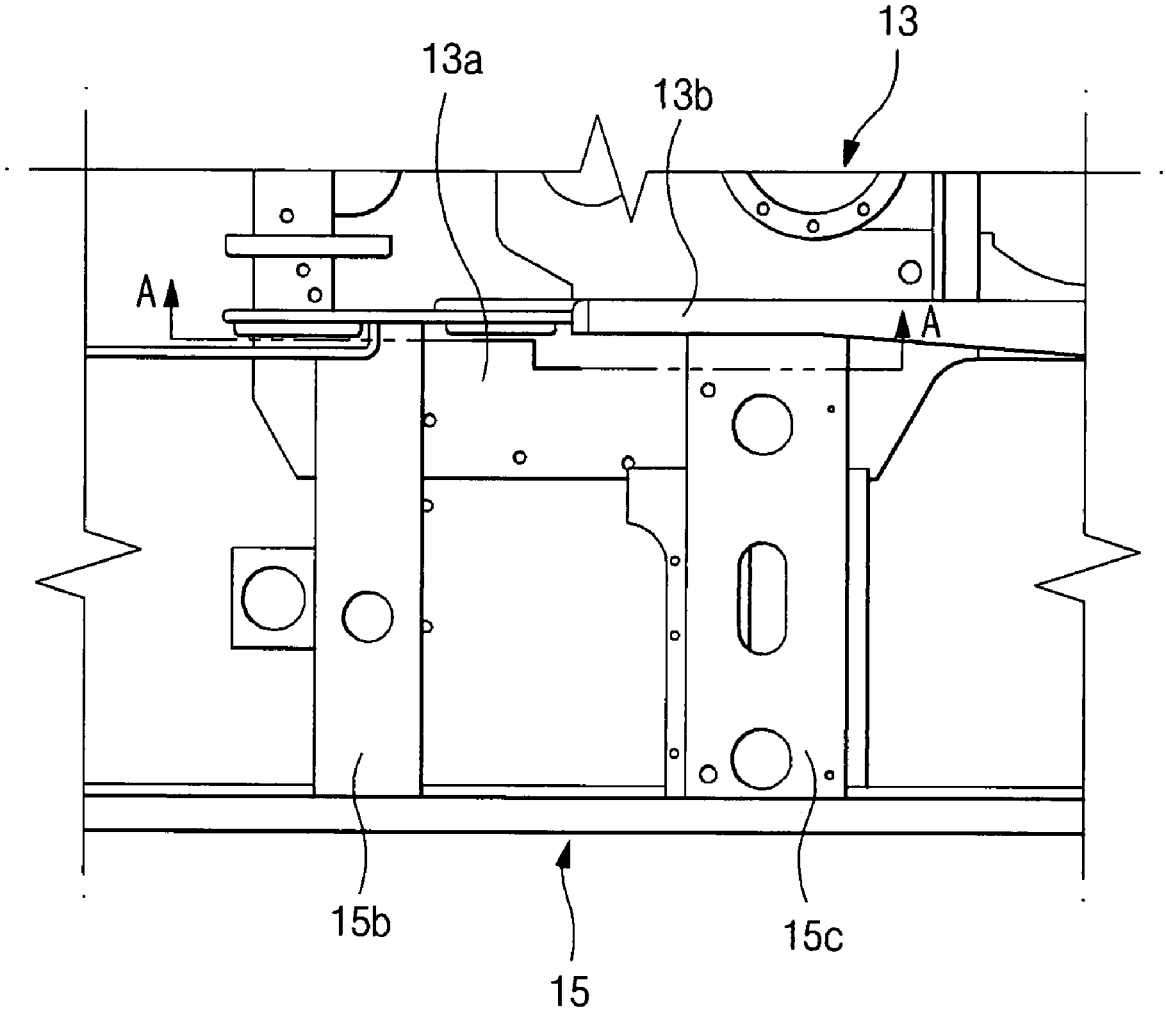
Fig. 2c Prior Art
FIG. 2C is a plan view of a left side frame fixed by welding to a center frame as illustrated in FIG. 2A.
Figure 2D:
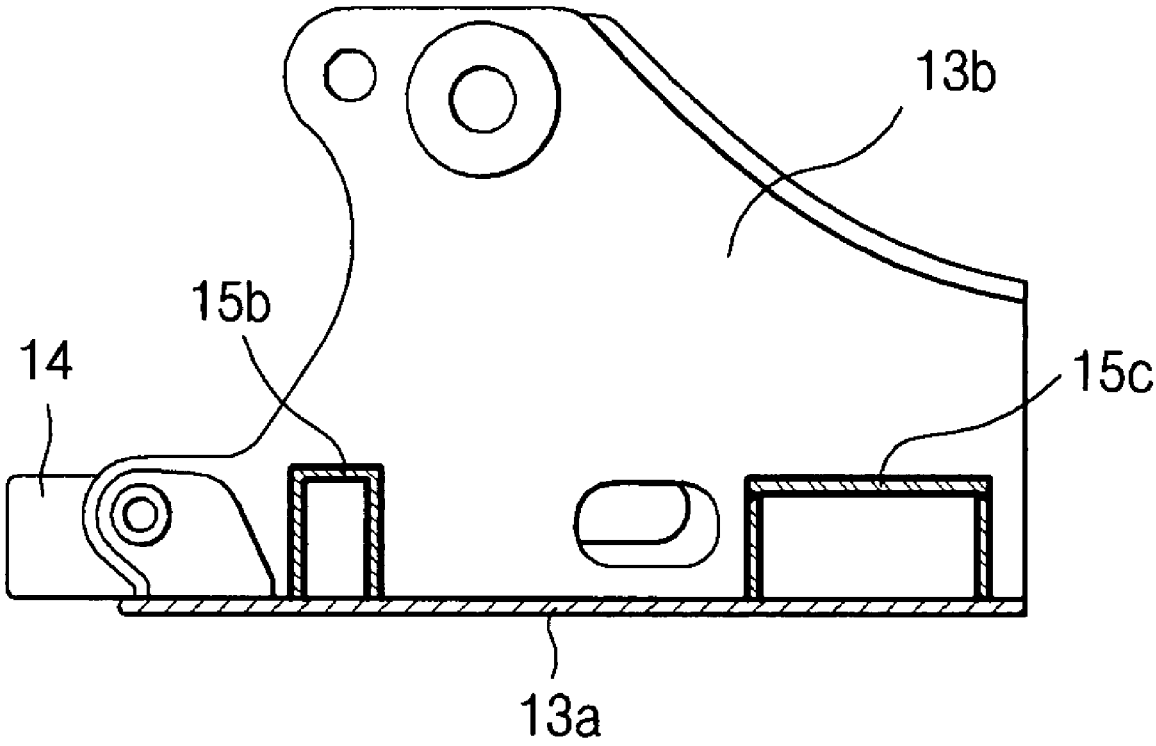
Fig. 2d Prior Art
FIG. 2D is a sectional view taken along A-A line of FIG. 2C.
Figure 3:
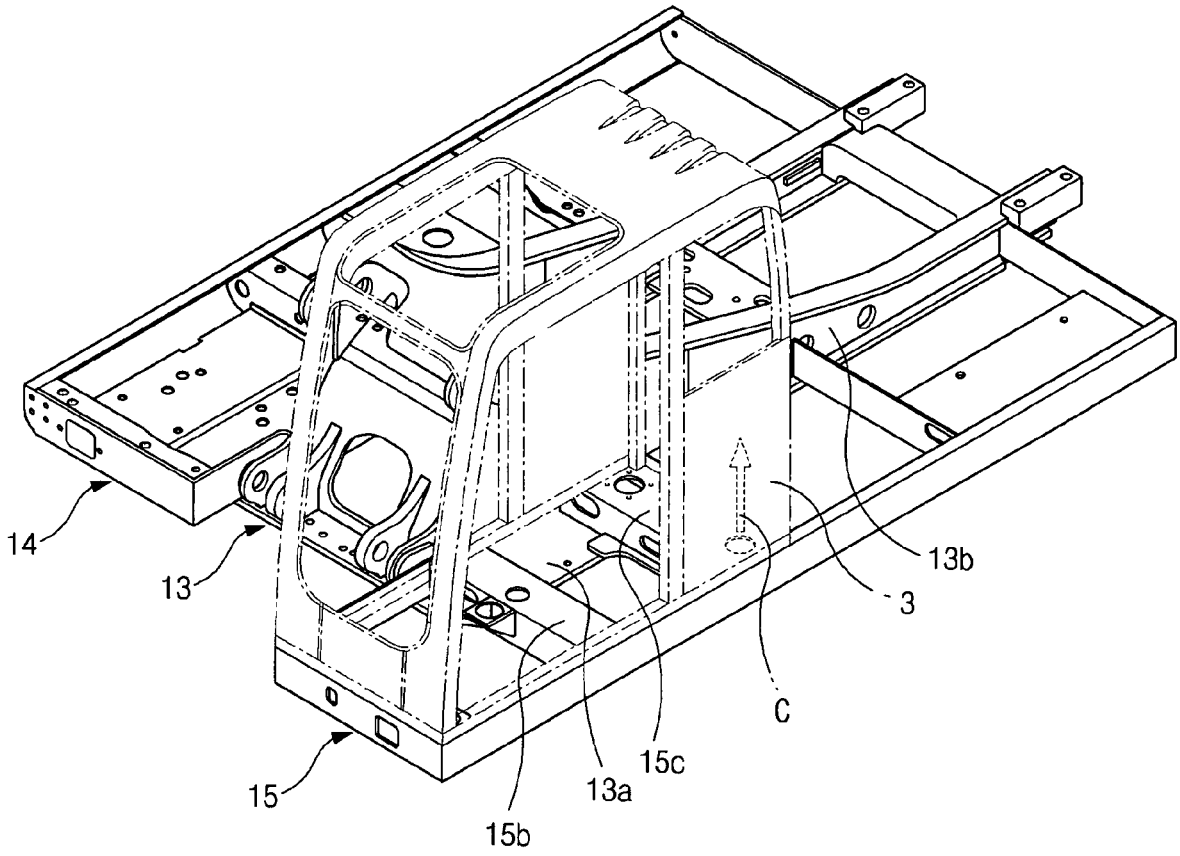
Fig. 3 Prior Art
FIG. 3 is a schematic view showing a conventional upper frame and a cab of construction machinery mounted on the upper frame.
Figure 4:
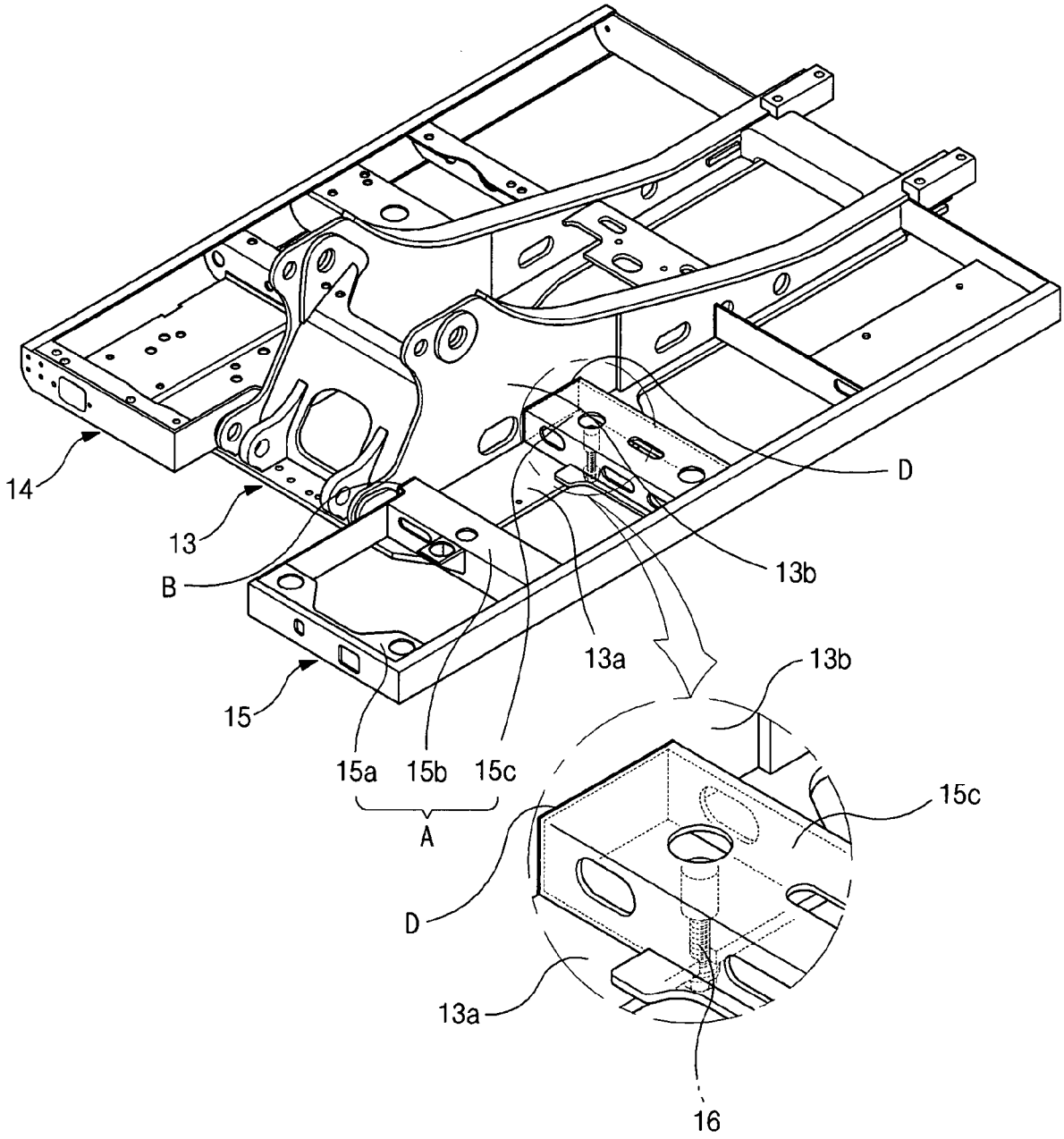
FIG. 4 is a perspective view of an upper frame structure for supporting a cab of construction machinery according to an embodiment of the present invention.
Figure 5:
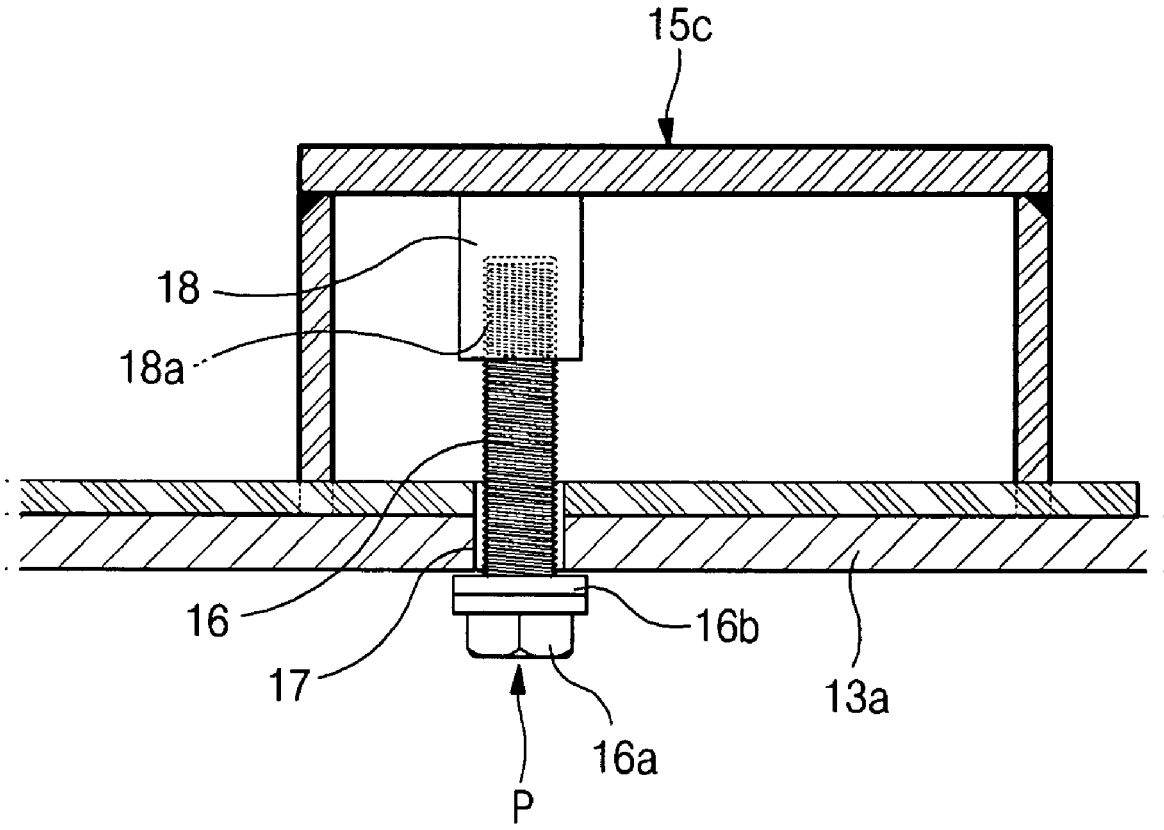
FIG. 5 is a view showing main parts of an upper frame structure as illustrated in FIG. 4.
Figure 6:
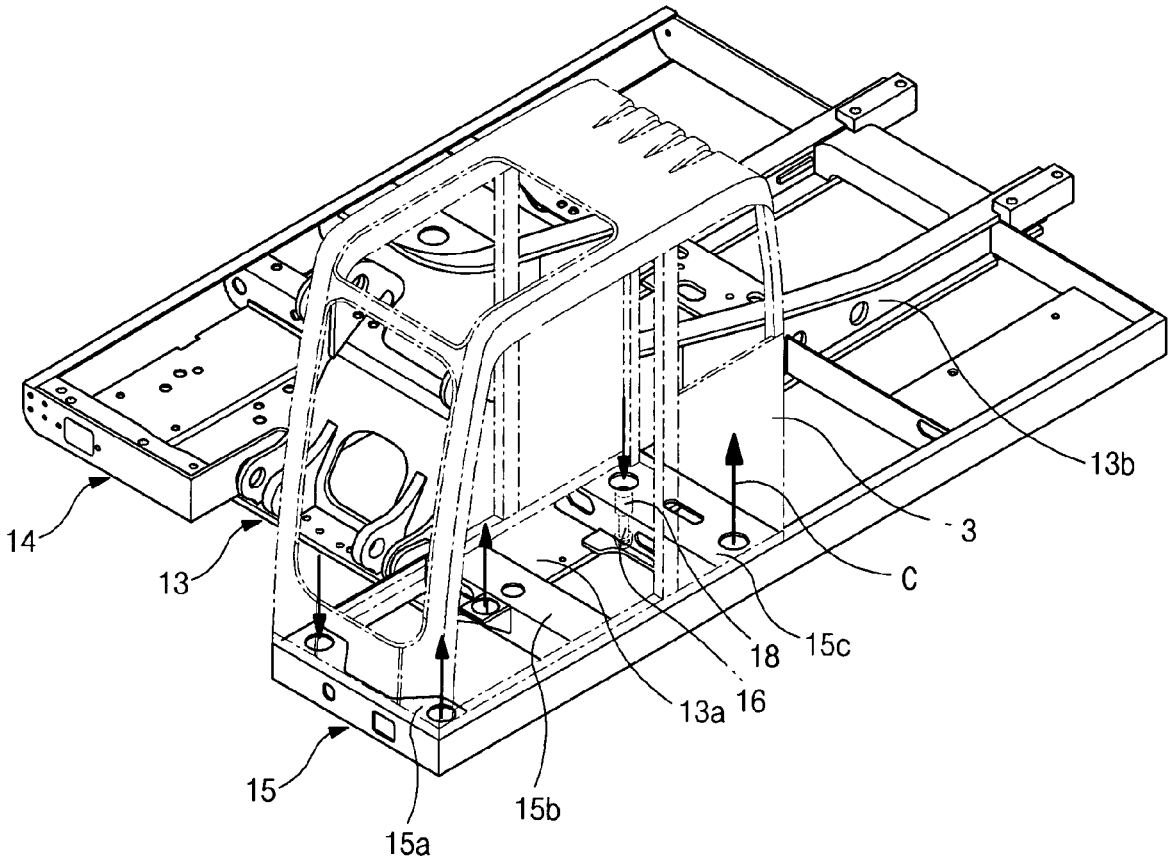
FIG. 6 is a view showing an upper frame structure for supporting a cab of construction machinery in a used state according to en embodiment of the present invention.

As shown in FIGS. 4 to 6, an upper frame structure for supporting a cab of construction machinery according to an embodiment of the present invention includes a center frame having a bottom plate on which a swing ring gear is mounted and a pair of side plates which are vertically fixed to the bottom plate and on which operation devices are mounted; and a left frame mounted on a left side of the center frame and having a left side frame on which the cab is mounted.

The upper frame structure also includes reinforcement members A (15*b* and 15*c*) each of which has one end fixed by welding to a side surface of the side plate 13*b* of the center frame 13 and the other end fixed by welding to a side surface of the left side frame 15, and on which the cap 3 is mounted; and a fastening member 16 installed on the bottom plate 13*a* to offset a load vertically applied to the cab 3 and a load laterally applied to the cab 3, and fixing the reinforcement member 15*c* to the bottom plate 13*a*.

A gap is formed between the bottom surface of the bottom plate 13*a* and a head part 16*a* of the fastening member 16 so that the shear force generated due to the moment that occurs at a welded portion D of the side plate 13*b* and the reinforcement member 15*c* is minimized by relieving a shock through the fastening member 16 when a load is vertically applied to the upper frame.

The fastening member 16 may be installed at an edge of the bottom plate 13*a*.

A fastening hole 17, which is in the form of an elongated hole or a hole and into which the fastening member 16 is fastened, may be formed on the bottom plate 13*a*.

A screw hole (not illustrated) may be formed on the reinforcement member 15*c* so that a screw part of the fastening member 16 is fastened into the screw hole. A nut member 18 on which a screw hole 18*a* is formed (e.g., a cylindrical boss on which a screw hole is formed) may be fixed by welding to a bottom surface of the reinforcement member 15*c* so that the screw part of the fastening member 16 is fastened into the screw hole.

The reinforcement member A may be selectively installed in the center (i.e., on the center reinforcement member 15*b*) or in the rear (i.e., on the rear reinforcement member 15*c*) of the left side frame 15. The reinforcement member A may be installed in the center and in the rear (corresponding to the center and rear reinforcement members 15*b* and 15*c*) of the left side frame 15.

At least one fastening member 16 may be installed at an edge of the bottom plate 13*a* (e.g., one fastening member 16 is installed). A washer 16*b* may be integratedly formed on the head part 16*a* of the fastening member 16.

Hereinafter, the features of the upper frame structure for supporting a cab of construction machinery according to an embodiment of the present invention will be described in detail with reference to the accompanying drawings.

Although it is exemplified that the fastening member 16 is fixed to the rear reinforcement member 15*c* which is fixed by welding to the side plate 13*b* (indicated as "D" in FIG. 4) and is located in the rear of the left side frame 15, it is also possible that the fastening member (not illustrated) is fixed to the center reinforcement member 15*b* which is fixed by welding to the side plate 13*b* (indicated as "B" in FIG. 4) and is located in the center of the left side frame 15.

As shown in FIG. 6, when a large load P, which is so much that the cap 3 is plastically deformed, is vertically applied to the cab 3 due to a rollover of the construction machinery, or when a large load is laterally applied to the cab 3 due to a landslide, the plastic deformation of the cab 3 can be minimized by dispersing and offsetting a load being transferred to the cab 3. Also, a shock being transferred inside the cab 3 can be minimized.

Specifically, the side surface (indicated as "D" in the drawing) of the reinforcement member A (e.g., the rear reinforcement member 15*c*), which is in close contact with an outer side surface of the side plate 13*b* of the center frame 13, is fixed by welding to the side plate 13*b*.

Also, the fastening member 16 is inserted into the elongated fastening hole 17 that is formed at an end of the bottom plate 13*a* of the center frame 13, and then the screw part of the fastening member 16 is fastened into the screw hole 18*a* of the nut member 18 that is fixed by welding to the bottom surface of the reinforcement member 15*c*. In this case, the fastening member 16 is fastened so as to secure a gap between its head part 16*a* and the bottom surface of the bottom plate 13*a*.

As described above, by fastening the reinforcement member 15*c* to the bottom plate 13*a* of the center frame with a bolt, the bending deformation of the bottom plate 13*a* occurring when the reinforcement member 15*c* is welded to the bottom plate 13*a* on which the swing ring gear (not illustrated) is mounted. That is, the structural vulnerability, in which the strength of the welded portion D is lowered in the case of fixing by welding only the side surface of the reinforcement member 15*c* of the left side frame 15 to the bottom surface 13*a* of the center frame 13 in manufacturing the upper frame, can be reinforced.

Accordingly, even if a large load is vertically applied to the left side frame 15 on which the cab 3 is mounted (indicated by an arrow C in FIG. 6), the cab 3 mounted on the left side frame 15 can be supported by the reinforcement member 15*c* the side surface of which is fixed by welding to the side plate 13*b* of the center frame 13 (indicated as "D").

In addition, since the reinforcement member 15*d* is fixed to the bottom plate 13*a* by the fastening member 16 installed at an edge of the bottom plate 13*a* of the center frame 13, the shear force generated due to the moment that occurs at the welded portion D of the side plate 13*b* and the reinforcement member 15*c* when the load is applied to the edge part of the left side frame (indicated by an arrow C) can be minimized.

Accordingly, when a large load, which is so much that the cab structure is plastically deformed, is vertically applied to the upper frame due to the rollover of the machinery, the head part 16*a* of the fastening member 16 becomes in contact with the bottom surface of the bottom plate 13*a*, and thus the load is offset. Accordingly, the shear force generated due to the moment that occurs at the welded portion D of the side plate 13*b* and the reinforcement member 15*c* is minimized, and thus the strength at the welded portion D can be reinforced.

Accordingly, even if a large load is vertically applied to the upper frame, the cap can be supported on the upper frame by the fixing force obtained by the welding of the side plate 13*b* of the center frame 13 to the side surface of the reinforcement member 15*c* (indicated as "D" in the drawing) and the fastening member 16 for fixing the reinforcement member 15*c* to the bottom plate 13*a* of the center frame 13.

As described above, by dispersing and offsetting the load occurring due to a shock being transferred to the cab 3, the plastic deformation of the cab 3 can be minimized. In addition, by minimizing the shock being transferred inside the cab, the operator can be protected from getting hurt.

From the foregoing, it will be apparent that the upper frame structure for supporting a cab of construction machinery according to an embodiment of the present invention has the following advantages.

The upper frame structure can secure the stability of the construction machinery by minimizing the plastic deformation of the cab mounted on the upper frame when a vertical shock, which is so much that the cab structure is plastically deformed, is applied to the upper frame.

In addition, in the case of mounting the cab on the upper frame, the upper frame structure selectively adopts the welding and the bolt fastening, and thus the structural vulnerability of a structure manufactured only by welding can be rectified with the working efficiency improved.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An upper frame structure for supporting a cab of construction machinery, including a center frame having a bottom plate on which a swing ring gear is mounted and a pair of side plates which are vertically fixed to the bottom plate and on which operation devices are mounted; and a left frame mounted on a left side of the center frame and having a left side frame on which the cab is mounted, the upper frame structure comprising:

at least one reinforcement members each of which has one end fixed by welding to a side surface of the side plate of the center frame and the other end fixed by welding to a side surface of the left side frame, and on which the cab is mounted; and a fastening member installed on the bottom plate to offset a load vertically applied to the cab and a load laterally applied to the cab, and fixing the reinforcement member to the bottom plate, wherein a screw hole is formed on the reinforcement member so that a screw part of the fastening member is fastened into the screw hole.

2. The upper frame structure of claim 1, wherein the fastening member is fixed to form a gap between a bottom surface of the bottom plate and a head part of the fastening member.

3. The upper frame structure of claim 1, wherein the fastening member is installed at an edge of the bottom plate.

4. The upper frame structure of claim 1, wherein a fastening hole, which is in the form of an elongated hole and into which the fastening member is fastened, is formed on the bottom plate.

5. The upper frame structure of claim 1, wherein a nut member is fixed by welding to a bottom surface of the reinforcement member so that the screw part of the fastening member is fastened into the nut member.

6. The upper frame structure of claim 1, wherein the reinforcement member is installed in the rear of the left side frame.

7. The upper frame structure of claim 1, wherein the reinforcement members is installed in at least one of the rear and center of the left side frame.

8. The upper frame structure of claim 3, wherein at least one fastening member is installed at an edge of the bottom plate.

9. The upper frame structure of claim 1, wherein a washer is integratedly formed on the head part of the fastening member.

10. The upper frame structure of claim 1, wherein the at least one reinforcement member comprises center and rear reinforcement members.

11. An upper frame structure for supporting a cab of construction machinery, including a center frame having a bottom plate on which a swing ring gear is mounted and a pair of side plates which are vertically fixed to the bottom plate and on which operation devices are mounted; and a left frame mounted on a left side of the center frame and having a left side frame on which the cab is mounted, the upper frame structure comprising:

at least one reinforcement member each of which has one end fixed by welding to a side surface of the side plate of the center frame and the other end fixed by welding to a side surface of the left side frame, and on which the cab is mounted; and a fastening member installed on the bottom plate to offset a load vertically applied to the cab and a load laterally applied to the cab, and fixing the reinforcement member to the bottom plate, wherein a nut member is fixed by welding to a bottom surface of the reinforcement member so that the screw part of the fastening member is fastened into the nut member.

* * * * *